United States Patent [19]

Abernethy et al.

[11] 4,274,691

[45] Jun. 23, 1981

[54] MODULAR JACK

[75] Inventors: Lynn W. Abernethy, Advance; Elvert S. Watts, Walkertown, both of N.C.

[73] Assignee: AMP Incorporated, Harrisburg, Pa.

[21] Appl. No.: 108,859

[22] Filed: Dec. 31, 1979

Related U.S. Application Data

[63] Continuation-in-part of Ser. No. 966,693, Dec. 5, 1978, abandoned.

[51] Int. Cl.[3] ..... H01R 31/08; H01R 13/54

[52] U.S. Cl. ..... 339/19; 339/126 R; 339/176 MP; 339/206 R; 339/278 C

[58] Field of Search ..... 339/91 R, 92 M, 99, 339/126 R, 19, 222, 176 M, 176 MP, 125, 17 C, 206, 278 C

[56] References Cited

U.S. PATENT DOCUMENTS

| | | | |
|---|---|---|---|
| T958,009 | 5/1977 | Snyder | 339/99 R |
| T961,003 | 8/1977 | Krumreich | 339/176 M |
| 3,065,440 | 11/1962 | Bonwitt | 339/19 X |
| 3,697,927 | 10/1972 | Kunkle | 339/19 |
| 3,744,009 | 7/1973 | Teagno | 339/17 C X |
| 3,797,108 | 3/1974 | Healy et al. | 29/630 C |
| 3,850,497 | 11/1974 | Krumreich | 339/176 M |
| 4,138,604 | 2/1979 | Harmsen et al. | 339/278 C X |
| 4,186,988 | 2/1980 | Kobler | 339/176 MP |

*Primary Examiner*—John McQuade
*Assistant Examiner*—John S. Brown
*Attorney, Agent, or Firm*—Gerald K. Kita

[57] ABSTRACT

An improved jack is disclosed for modular telephone interconnection. One or more shorting components are plugably mounted in a wall of the jack to common electrically selected beam contacts which are mounted in a base portion of the jack which protrude outwardly for plugable electrical connection in a circuit board. The contacts are stamped and formed from metal strip and then stripe plated with gold along the areas to be engaged by a plug type connector intermated with the jack.

7 Claims, 9 Drawing Figures

MODULAR JACK

This application is a continuation-in-part of application Ser. No. 966,693, filed Dec. 5, 1978, now abandoned.

FIELD OF THE INVENTION

The present invention relates to improvements in a standard jack for a national telephone network.

BACKGROUND OF THE INVENTION

A jack is disclosed in U.S. Pat. No. 3,850,497 in which a plurality of spring contacts project into a plug receiving cavity. Each contact is spliced by a compression sleeve connection to a corresponding insulated wire.

SUMMARY OF THE INVENTION

A jack according to the present invention includes spring beam contacts which protrude from a base of the jack for plugable connection in a circuit board. The free ends of the contacts project into the plug receiving cavity of the jack and are separated from one another by partitions molded into a back wall of the jack. One or more shorting elements are plugably mounted into the back wall and project into the plug receiving cavity for engagement by selected contacts.

The contacts are stamped and formed from flat metal strip and are joined to a continuous carrier strip. The carrier strip conveys the contacts through a gold plating bath. Being flat, the contacts are readily plated with a gold stripe over restricted flat areas as the contacts are conveyed through the bath.

In one embodiment, the base is fabricated as a separate molded part and includes molded side rails which slideably interfit with grooved tracks in side walls of the housing. The rails latch to the side walls to complete the assembly.

To adapt the jack for mounting on a circuit board, the spring contacts protrude from the base and are provided with plugable leads of a desired configuration.

OBJECTS

An object of the present invention is to provide a jack type electrical connector having a plurality of spring contacts which have gold plating over limited areas, and which are provided with electrical leads for plugable connection in a circuit board.

Another object of the invention is to provide a connector of the type in which free ends of selected spring contacts are stripe plated with gold and project into a plug receiving cavity and engage electrical commoning components.

Another object of the invention is to provide a connector with one or more plugably mounted components which plug into selected partitioned spaces of a plug receiving cavity for engagement by selected spring beam contacts which are gold plated over selected areas and which are mounted in a base of the connector and which project into the cavity and into the partitioned spaces.

Additional objects and advantages of the present invention will become apparent from the following detailed description taken in conjunction with the accompanying drawings.

DRAWINGS

FIG. 3 is an enlarged perspective of a fully assembled jack with parts broken away to illustrate the details thereof, the assembled jack being further illustrated in exploded configuration from a circuit board.

DETAILED DESCRIPTION

Figure 1:
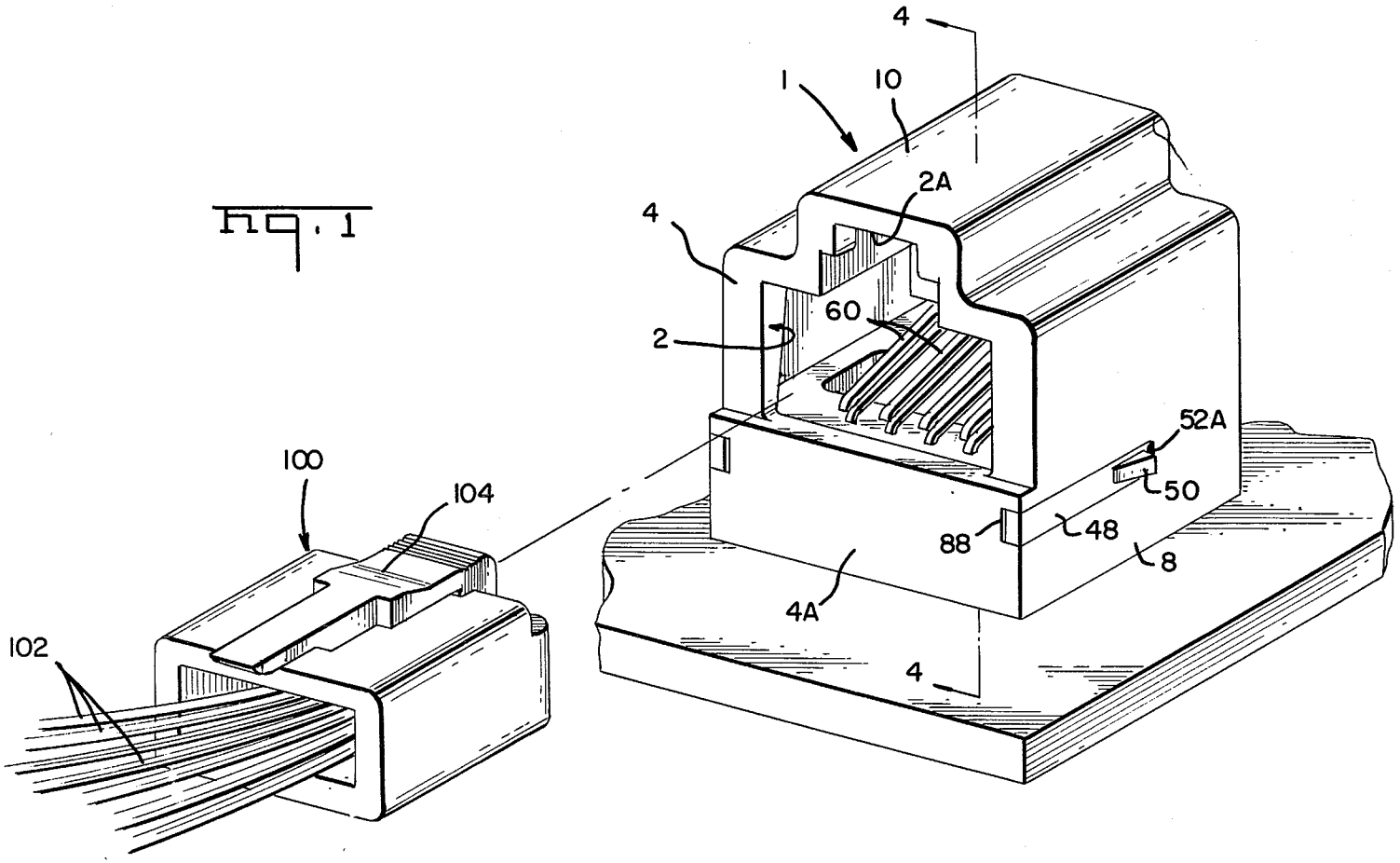
FIG. 1 is an enlarged fragmentary perspective of one embodiment of a modular jack according to the present invention mounted on a printed circuit board and having a plug receiving cavity for plugable receipt therein of a plug shown in exploded configuration.

With more particular reference to FIG. 1, there is shown generally at 1 a preferred embodiment of a jack according to the present invention comprising a molded dielectric portion of a housing having a plug receiving cavity generally illustrated at 2 through an upper portion of a front wall 4 of the housing. The front wall 4 bridges between and is integral with a pair of opposed spaced side walls 6 and 8 which are, in turn, integral with a polygonal top wall 10, which defines a narrow keyway 2A opening axially into the plug receiving opening 2. As shown more particularly in FIGS. 3 and 4, the top wall 10 is provided with depending latching projections, one of which is shown at 12, protruding partially into the plug receiving cavity 2, and along the front wall 4.

Figure 4:
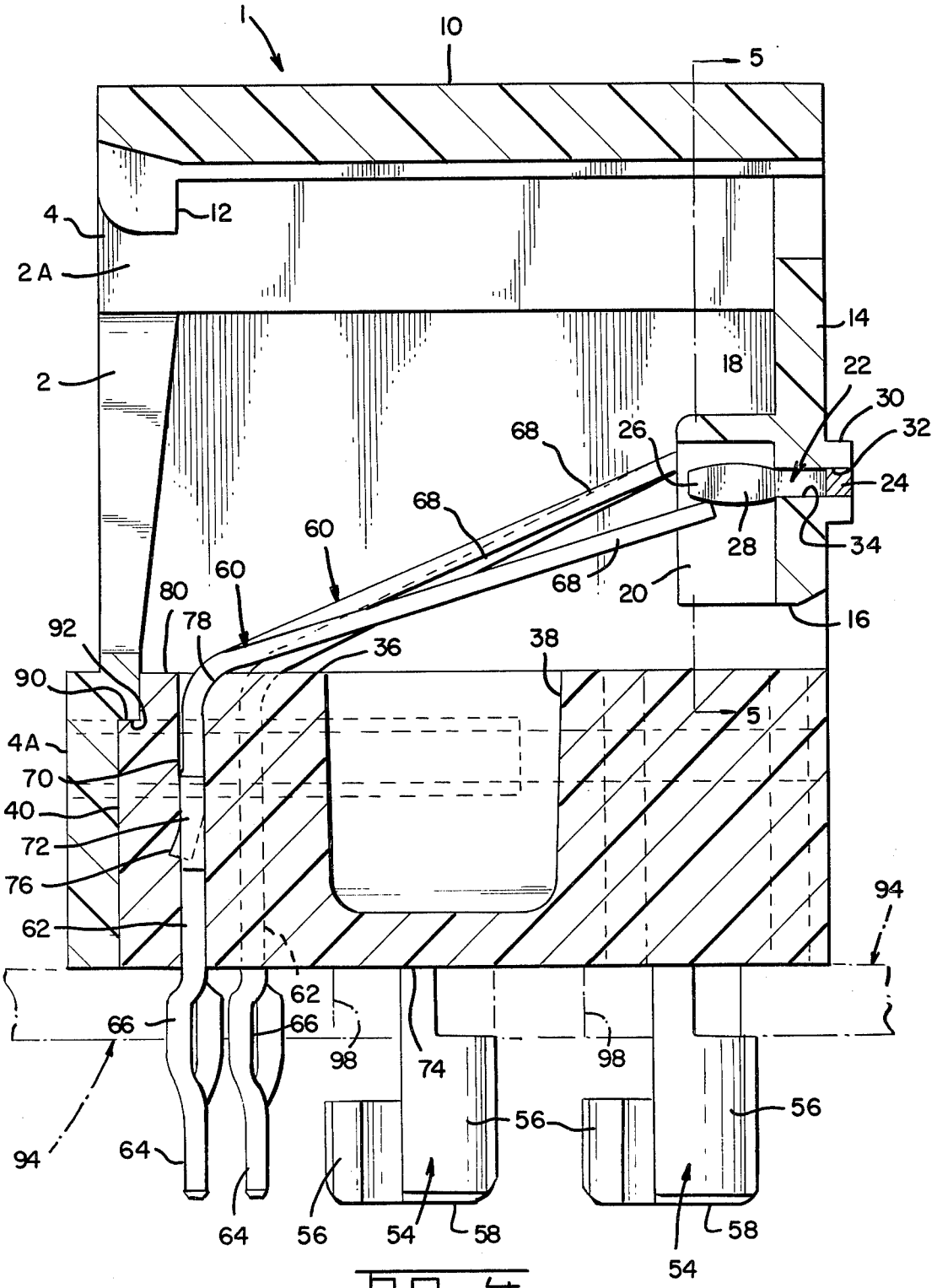
FIG. 4 is an enlarged side elevation in side section of the jack illustrated in FIG. 1.
Figure 5:
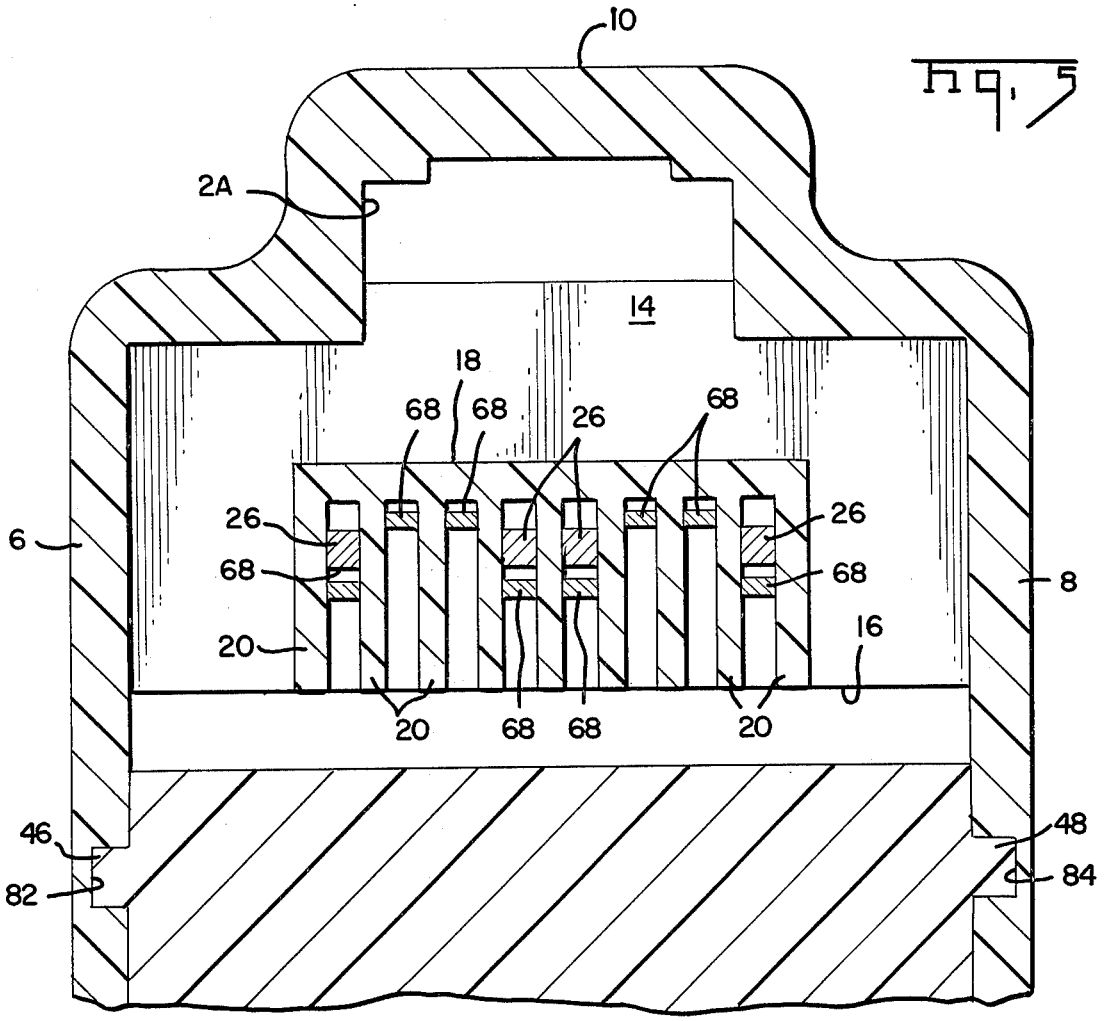
FIG. 5 is a section taken along the line 5—5 of FIG. 4.
Figure 6:
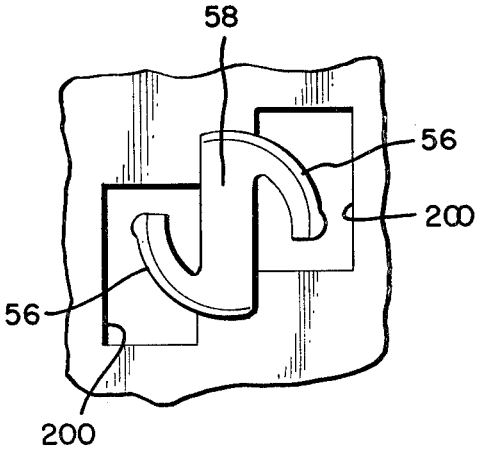
FIG. 6 is a fragmentary bottom plan of a portion of the jack.
Figure 7:
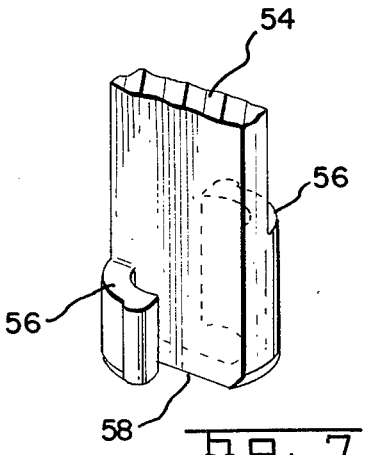

FIGS. 4 and 5 more particularly illustrate a molded back wall 14 of the housing having a depending end surface 16 bridging across the space between the side walls 6 and 8. The back wall 14 is molded with an integral shelf 18 projecting perpendicularly outward of the wall 14 and into the plug receiving cavity 2. The shelf 16 further is provided with a plurality of parallel depending partitions 20, integral also with the back wall 14 and terminating above the end surface 16. The spaces between the partitions open into the plug receiving cavity 2 and also open along their bottom sides opposite the shelf 18.

Figure 2:
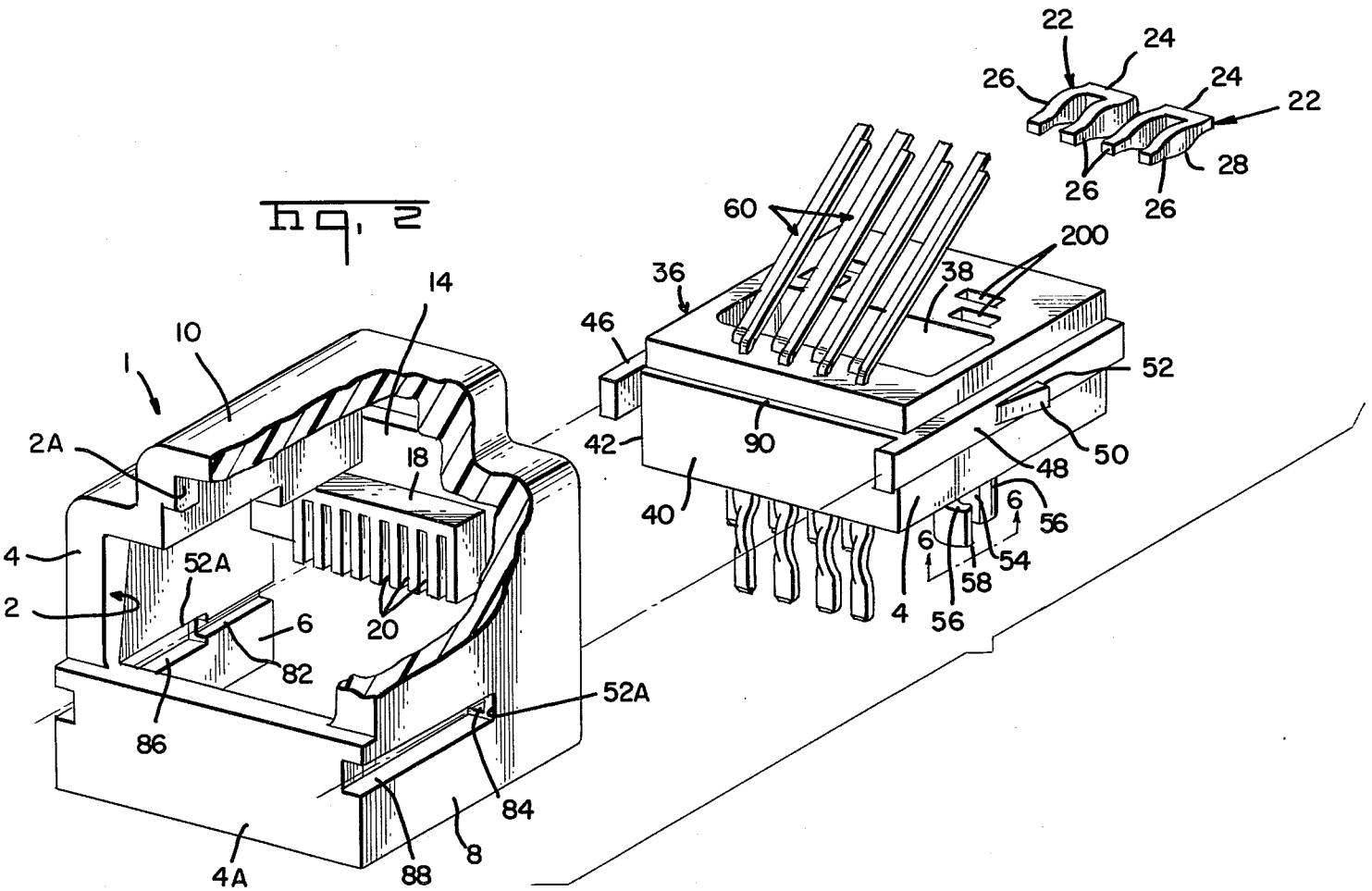
FIG. 2 is an enlarged perspective with parts in exploded configuration and with parts partially broken away to illustrate the details of the component parts of the jack shown in FIG. 1.

As shown more particularly in FIGS. 2 and 4, a pair of generally U-shaped metal components is illustrated generally at 22. Each component includes an elongated base or bar portion 24 having a plurality of integral prongs 26 projecting outwardly therefrom. Each of the prongs 26 has a relatively wide mid-section 28.

FIG. 4 illustrates the back wall 14 being provided with an integral projecting base 30 elongated axially with the bar portion 24 and provided with a groove 32 into which the bar portion 24 interfits. The groove 32 communicates with passageways or openings 34 passing through the back wall 14 and communicating with selected spaces between corresponding partitions 20. Each opening 34 is complimentary in section to that of a corresponding prong 26.

The enlarged mid-section 28 of each prong is forceably inserted through a corresponding opening 34 until disposed within a selected space between corresponding partitions 20. The dielectric material of the housing will resiliently be compressed to permit passage of the enlarged mid-section 28 through the opening 34. Once the mid-section fully passes through the opening 34, the dielectric material of the housing will expand resiliently to conform around the prong 26, preventing withdrawal thereof. Thus, as shown in FIG. 4, each shorting element 22 will be mounted with its bar portion 24 fully recessed within the groove 32 and the corresponding prongs 26 projected into selected spaces between corresponding partitions 20. Removal of each shorting element can be accomplished by use of a tool such as a pair of pliers.

FIG. 2 illustrates a molded dielectric base portion 36 having a central, generally T-shaped, vertical recess 38 therein. The base includes a front wall portion 40 spanning between opposed spaced side wall portions 42 and 44. The side wall portions are provided with integral, horizontally projecting, rails 46 and 48. Each of the rails, such as the rail 48, is provided with an integral projecting wedge-shaped latch 50 having a latching shoulder 52. The rails 46 and 48 also project slightly forwardly of the front wall portion 40. The base 36 further is molded with one or more depending elongated feet 54 having projecting latching shoulders 56 adjacent an end 58.

As shown in FIG. 2, the front wall portion 40 is relatively thick and includes a plurality of spring beam contacts, illustrated generally at 60, arranged in two staggered rows. Each contact is shown more in detail in conjunction with FIGS. 2 and 4. Each contact 60 is of one piece metal, stamped and formed with an elongated mid-portion 62 which is of relatively thick cross section. One end 64 of each contact is bifurcated at 66 with the bifurcated portions being deformed to project laterally of the axis of the contact to provide an interference fit within a circuit board aperture. The opposite end 68 of each contact 60 is designated the free end, and has a relatively reduced cross section which extends for a substantial length of each contact until it joins mid-portion 62 at 70. The relatively thick front wall portion 40 of the base is provided with a two row series of staggered vertical recesses 72 each of a section complimentary with the mid-portion 62 of a corresponding contact 60. The reduced cross section free end 68 of each contact is inserted into and along a corresponding recess 72 until the bifurcated portion 66 thereof is in adjacent depending relationship with a bottom wall 74 of the base 36. The mid-section 62 of the contact will be disposed within a corresponding recess 72. The mid-section 62 further may be provided with one or more integral projecting spurs 76 which will bite into the dielectric material of the base 36 to retain the contact in the corresponding opening 72. Each recess 72 further is provided with a shoulder 78 where it communicates with a top surface 80 of the base 36. The reduced section of the contact 60 is manually bent over the shoulder 78 to project diagonally outward from the recess 72, using the arcuate shoulder 78 as an anvil. Some compression of the shoulder will occur, causing an arcuate shape thereof as shown in FIG. 4.

FIG. 2 illustrates the manner of assembly of the base 36 with the housing portion 1. The base portion 36 is traversed under the end surface 16 with the rails 46 and 48 slideably traversing along recessed grooves 82 and 84, respectively. The grooves 82 and 84 communicate axially with the plug receiving cavity 2 and also with corresponding narrow keyways 86 and 88, which extend laterally through the side walls and which extend axially through a thickened front wall portion 4A, located at the lower side of the plug receiving cavity 2. In the completed assembly shown in FIGS. 3 and 4, the rails 46 and 48 will register within the corresponding keyways 86 and 88. Since the rails 46 and 48 project outwardly beyond the wall 40, the projecting portions of the rails will impinge on either side of the front wall 4A, when the wall 40 abuts the wall 4A. The wall 40 is provided with a shoulder 90 which impinges against a complimentary undercut shoulder 92 provided on the front wall 4A. The projecting latches 50 of the rails 46 and 48 will be forceably traversed along the grooves 82 and 84 until they are free to project outwardly into the ends of the keyways 86 and 88 immediately adjacent to the corresponding grooves 82 and 84. More particularly, shoulders 52A are provided at the ends of the keyways 86 and 88 against which the shoulders 52 of the corresponding latches 50 register.

As shown more particularly in FIG. 5, the free ends 68 of the contacts 60 traverse under the end surface 16, resiliently deflecting in cantilever fashion to insure entry of the contacts into the plug receiving cavity 2. Once in the cavity, the contact free ends 68 will spring in cantilever fashion outwardly away from the top surface 80 of the base portion and will enter into corresponding spaces between the partitions 20. The partitions 20 thereby separate and electrically insulate the contact free ends 68 from one another. Selected ones of the contact free ends 68 will also deflect by cantilever spring action away from the base and into engagement with corresponding prongs 26 which project into selected spaces between the partitions 20. Thereby, the shorting element will electrically common the engaging corresponding contact free ends 68. As shown in FIG. 5, the contacts in positions 1 and 4 are electrically commoned, and the contacts in positions 5 and 8 are electrically commoned. Other combinations of shorting elements may be utilized for selectively commoning together desired spring contact ends 68.

FIG. 3 illustrates the assembled jack being mounted on a printed circuit board generally located at 94 having electrical lead receiving apertures 96 which are arranged in two staggered rows for plugable receipt of the electrical leads 64 therein. The bifurcated portions 66 of the leads 64 are received wedgingly in corresponding apertures 96. In a manner well known, the circuit board 94 includes plated metal pads which establish electrical connection with the leads 64 when plugably received into the apertures 96, which themselves are lined with metal plating. Additional apertures 98 are provided in the circuit board 94 for plugably receiving the feet 54, the shoulders 56 of which latch under the bottom surface of the board 94 to mechanically secure the housing to the circuit board.

Figure 7:
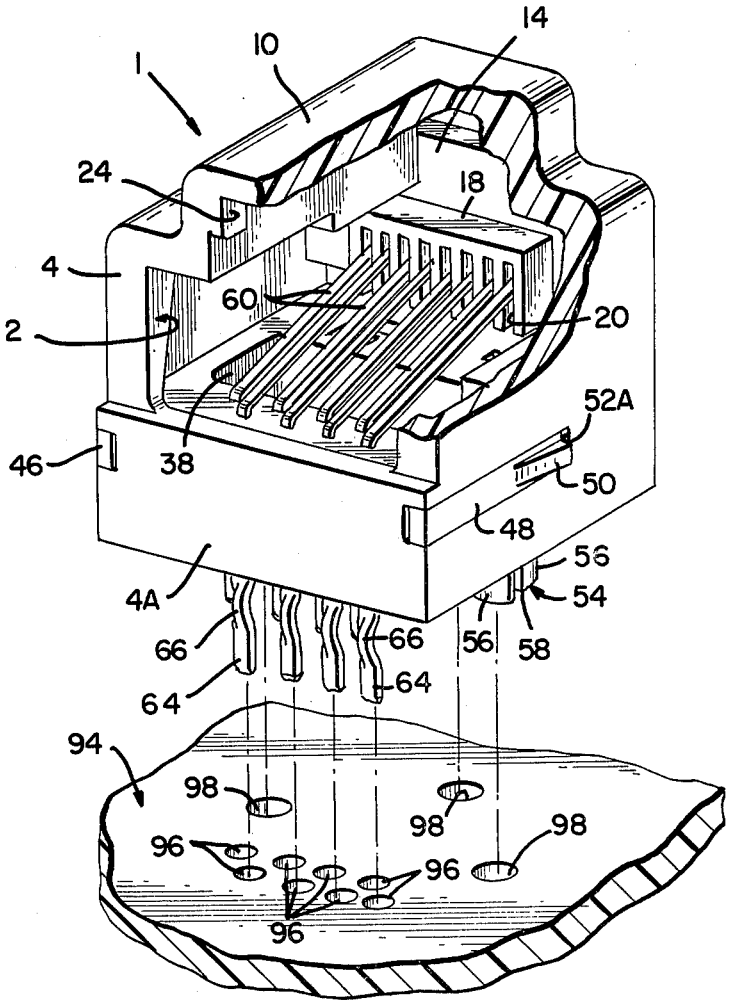
FIG. 7 is a fragmentary enlarged perspective of a foot of the jack.

FIG. 7 illustrates each of two core pin apertures 200 through the bottom 74 which enable molding of the shoulders 56 at elevations below that of the bottom 74. The shoulders 56 are provided on flexible ears which project laterally outward of the central post portion. The ears are deflected inwardly toward the post portion when traversing through an aperture. Once emerging from the bottom side of the board, one, or both, ears will resiliently spring outwardly of the post and overlie the bottom of the circuit board 94. The shoulders 56 of ears are at different spacings along the post portion to accommodate boards of different thicknesses. Both shoulders will spring out when a thin board is accommodated. Only one shoulder of the shorter ear may spring out if the other taller ear remains within the aperture of a thick board.

FIG. 1 illustrates generally at 100 an electrical plug type connector secured to the ends of a plurality of electrical wires 102. The plug is provided with a molded latch 104. The plug 100 is plugably received into the plug receiving cavity 2, with the latch 104 plugably received in the keyway 2A of the housing 1. In a manner well known, the wires 102 are provided with electrical contacts which are well known and, therefore, not shown. These contacts engage corresponding electrical contacts 60 thereby establishing electrical connections of the wires 102, to the contacts 60. Electrical continuity is established from the contacts 60, through the leads 64 and into the circuit paths on the circuit board 94.

Figure 8:
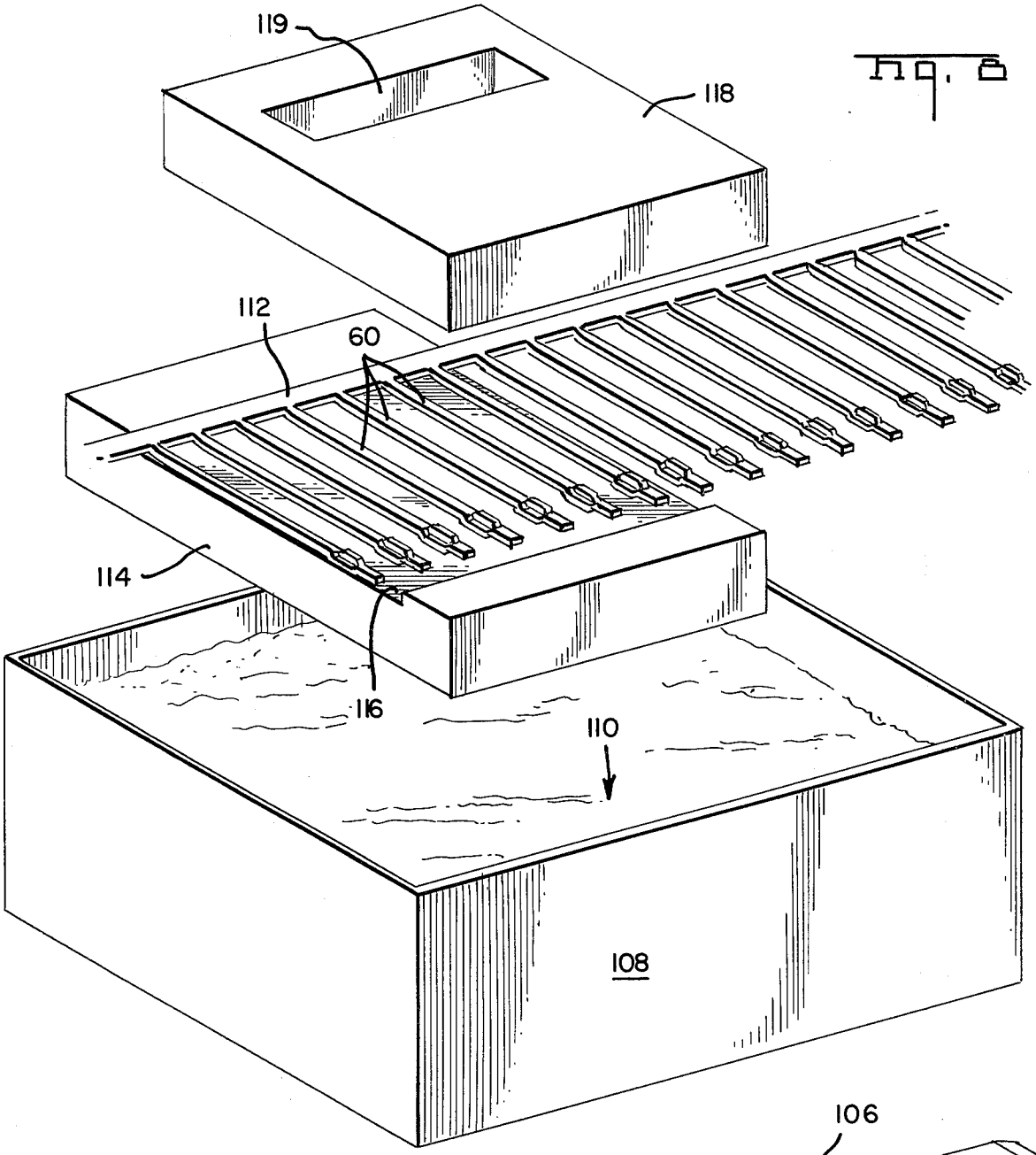
FIG. 8 is a diagrammatic view of a carrier strip and flat terminals together with apparatus for plating gold stripes on limited areas of the terminals.
Figure 9:
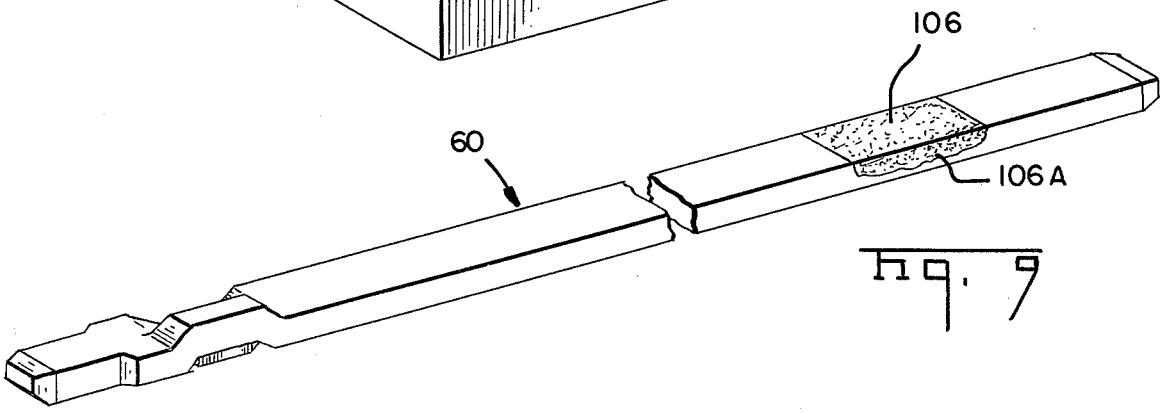
FIG. 9 is a plan view of a flat terminal provided with a gold stripe on a limited area of the terminal.

The plug contacts and the jack contacts 60 are gold plated to assure good electrical continuity when interengaged. Each jack contact 60 is provided with a gold stripe 106 plated on an area expected to be engaged by a plug contact. The gold stripe is applied by plating techniques disclosed in either of U.S. Pat. Nos. 3,644,181; 4,001,093; 4,033,833 and Re 28,267, all relating to gold plating on limited areas. FIG. 8 shows a vessel or tank 108 containing an electrolyte bath 110 suitable for electroplating gold metal onto a cathode, in the form of a plurality of electrical terminals 60 still in their flat forms as they are stamped and formed from metal strip. The contacts remain attached to a carrier strip 112, also stamped and formed from the mentioned metal strip. The contacts may be plated with nickel alloy or copper alloy to provide a base with an affinity for electrolytic gold plating. A plastic fixture block 114 with no affinity for gold plating receives the contacts 60 and carrier strip 112 along a shallow channel 116 in the top surface of the block 114. Another plastic fixture block 118 overlies the block 114 and is secured thereto by any well known fasteners, such as plastic screws, not shown. The block 118 has a window 119 therethrough which exposes limited surface areas of the contacts 60 onto which gold is to be plated. The assembly of fixture blocks and the strip is immersed in the bath 110, with the strip 112 drooping in catenary fashion.

The strip 112 and contacts 60 are connected in an electrical circuit, as a cathode, and with a suitable anode, such as a carbon block, not shown also in the circuit. The anode may be immersed in the bath and placed in the window 119 in close proximity to the limited areas of contacts 60 exposed by the window. A source of electrical current in the circuit is energized and causes gold ions in the bath 110 to plate onto the contacts 60 in close proximity to the anode, where the greatest current density will pass through the bath between the anode and cathode. The strip 112 is pulled continuously through the channel 116 at a controlled speed, such that the contacts along the strip pass under the window 119 which contains the anode. In this manner all of the contacts will have the gold stripes 106 plated along limited areas exposed by the window 119. Some gold plating will appear as uneven overplating 106A on the side edges and on the under surface of the terminals 60, due to stray current densities. However, since these stray current densities are weak, and since the terminals pass continuously along and through the fixture blocks, the thickness of the overplating is small and contains negligible gold metal. The surfaces on which the overplating 106A occurs are not engaged by the plug contacts.

Although a preferred embodiment of the present invention has been described and disclosed in detail, other modifications and embodiments thereof which would be apparent to one having ordinary skills are intended to be covered by the spirit and scope of the appended claims.

What is claimed is:

1. In a jack type connector having a molded base and a molded cover cooperating to form an internal cavity and a plurality of elongated spring contacts mounted in said base and projecting into said cavity for engaging electrically the electrical terminals of a plug type connector when the same is pluggably inserted into said cavity, the improvement comprising:

said contacts having electrical lead portions depending outwardly of said base for pluggable connection in a circuit board which mounts said base, said contacts having resilient free ends projecting outwardly of said base and into said cavity, said cover includes a first end wall having an opening communicating with said cavity and profiled to compliment the profile of said plug type connector, a second end wall of said cover having a base receiving opening, side walls of said cover connecting said end walls, projecting rails along sides of said base slidably received along grooves in said cover side walls and extending from said base receiving opening toward said first end wall, said rails projecting from an end of said base and impinging sides of said first end wall.

2. The structure as recited in claim 1, wherein, said cover includes means within said cavity for separating said contacts from one another, said second end wall is provided with openings, and one or more conductive interconnected prongs inserted through said openings and communicating with said means, said prongs engaging and commoning selected ones of said contacts.

3. The structure as recited in claim 1, wherein said cover side walls include keyways axially communicating with said grooves and extending into said sides of said first end wall, said rails project along said grooves and along said keyways.

4. The structure as recited in claim 3, wherein, a shoulder is defined at the intersection of each said keyway with a said groove, and each said rail includes a projecting latch in registration with a corresponding said shoulder.

5. The structure as recited in claim 1, wherein, said base is molded with integral feet depending in the same direction as said lead portions, each of said feet including two ears projecting laterally outward of an integral post portion, said ears being resilient for deflection inwardly toward said post portion upon passage within an aperture of a circuit board, and said ears being at different spacings along said post portion so that one, or both, of said ears are capable of resilient spring deflection outwardly of said post portion so that one said ears overlies a bottom of a circuit board which mounts said base.

6. The structure as recited in claim 1, wherein each said contact is plated on a limited area thereof with gold.

7. The structure as recited in claim 2, wherein each said contact is plated on a limited area thereof with gold.

* * * * *